US008800075B2

(12) United States Patent
van Leyen et al.

(10) Patent No.: US 8,800,075 B2
(45) Date of Patent: Aug. 12, 2014

(54) SPRING LOADED DOCKING MECHANISM

(75) Inventors: Jan Christopher van Leyen, Orange, CA (US); Shoufeng Li, Xiamen (CN)

(73) Assignee: Price Pfister, Inc., Lake Forest, CA (US)

( * ) Notice: Subject to any disclaimer, the term of this patent is extended or adjusted under 35 U.S.C. 154(b) by 545 days.

(21) Appl. No.: 13/205,201

(22) Filed: Aug. 8, 2011

(65) Prior Publication Data

US 2013/0037626 A1 Feb. 14, 2013

(51) Int. Cl.
*E03D 1/04* (2006.01)

(52) U.S. Cl.
USPC ..... 4/678

(58) Field of Classification Search
USPC ..... 4/675, 677, 678
See application file for complete search history.

(56) References Cited

U.S. PATENT DOCUMENTS

| | | | | |
|---|---|---|---|---|
| 6,619,567 | B1 | 9/2003 | Ouyoung | |
| 6,845,526 | B2 | 1/2005 | Malek et al. | |
| 7,699,241 | B2 | 4/2010 | Benstead | |
| 7,753,079 | B2 | 7/2010 | Nelson | |
| 7,909,061 | B2 | 3/2011 | Nelson | |
| 8,104,512 | B2 * | 1/2012 | Nelson et al. | 137/801 |
| 8,496,028 | B2 * | 7/2013 | Nelson et al. | 137/801 |

* cited by examiner

*Primary Examiner* — Huyen Le
(74) *Attorney, Agent, or Firm* — Barnes & Thornburg LLP

(57) ABSTRACT

An improved docking assembly for faucets having a pull-down sprayhead extendable from a spout. The docking assembly generally comprises a receptacle fitted into the spout which is formed with chamfered interior walls. A spring-loaded flexible collet is contained within the receptacle with a degree of sliding freedom for spring-biased travel along the chamfered interior walls of the receptacle, from a first position that allows generous radial expansion of the collet to a second position in which radial expansion is restricted. A quick-connect fitting attached to the pull-down sprayhead moves the collet into its first position allowing radial expansion of the collet. Removal of the quick-connect fitting moves the collet to its second position which restricts radial expansion, inhibiting said removal. Consequently, the pulldown sprayhead may be docked to the spout with considerably less insertion force than the opposite removal force needed to undock the pulldown sprayhead from the spout.

15 Claims, 4 Drawing Sheets

SPRING LOADED DOCKING MECHANISM

BACKGROUND OF THE INVENTION

1. Field of the Invention

The present invention relates to faucet sprayheads, and more particularly to a pull-down sprayhead docking mechanism for kitchen faucets that provides significantly less force to dock than to undock, and a longer operational lifetime.

2. Description of the Background

Faucets, especially kitchen faucets, are commercially available in numerous designs and configurations. Many are equipped with pull-out spray heads that enable more flexible cleaning. There are a variety of docking mechanisms which facilitate removal and return of the spray head from the faucet. These include twist-and-lock docking mechanisms, compression-fit or detent-lock docking mechanisms, and magnetic docking mechanisms. Design goals for such docking mechanisms include ease of docking, secure retention of the sprayhead when docked, ease of undocking, and consistent operation without degradation of the foregoing qualities over a long operational lifetime.

An example of a detent-lock mechanism is U.S. Pat. No. 6,845,526 to Malek et al. issued Jan. 25, 2005, which shows a pullout spray head with detent-fit docking collar with enhanced retaining force. The docking collar has an annular wall with a plurality of U-shaped slots which define a plurality of cantilevered snap fingers that fit into grooves in the connecting shaft when the spray head is docked.

Many mechanical docking designs on the market today rely on crush ribs to provide the necessary sprayhead retention. A form of detent-lock, these crush ribs about the base of the sprayhead or inside the faucet head deform during insertion to facilitate engagement there between. Unfortunately after several cycles the crush rib material abrades and retention decreases.

U.S. Pat. No. 6,619,567 to Ouyoung issued Sep. 16, 2003 shows a flexible water tap with pull-out sprayhead that uses a friction-fit dock (FIG. 8).

U.S. Pat. No. 7,699,241 to Benstead issued Apr. 20, 2010 shows a docking collar for a pull-out spray head. This docking collar includes a spring ring.

U.S. Pat. No. 7,909,061 to Nelson issued Mar. 22, 2011 shows a magnetic coupling for releasably coupling the faucet head to the faucet body.

Of the foregoing and others, only the magnetic couplings provide a differential docking force, vis-à-vis a uniform attractive force whether the sprayhead is being docked or undocked.

Magnets, however, are expensive. A purely mechanical docking system would be preferable, but in this context there are no known efforts to provide a differential docking force, requiring less force to dock than to undock. Moreover, conventional crush-rib type designs wear out and lose their retention ability. What is needed is a mechanical docking system that allows for the retention geometry to flex in order to reduce wear and tear, thereby prolonging the operational lifetime.

The present invention provides a purely mechanical docking system that requires significantly less force to dock than to undock, keeps the pull-down sprayhead securely in place when docked, and maintains registry of the internal components so that the spray head dock will never sag or degrade. Moreover, the retention geometry eliminates wear and tear of components resulting in a longer operational lifetime without any performance degradation.

SUMMARY OF THE INVENTION

The present invention provides improved docking assembly for a faucet including a pull-down/pull-out sprayhead extendable from a spout. The docking assembly generally comprises a receptacle fitted into a distal spout aperture of the faucet spout. The receptacle is formed as a generally annular member having chamfered interior walls. In addition, a spring-loaded flexible collet is slidably contained within the receptacle and has a degree of freedom for spring-biased travel along the chamfered interior walls of the receptacle, from a first position that allows limited radial expansion of the collet to a second position in which radial expansion of said collet is more restricted. A quick-connect fitting is attached to the pull-down sprayhead for insertion and removal into/from the collet. Upon docking of the sprayhead, insertion of the quick-connect fitting moves the collet into its first position allowing radial expansion of said collet to accommodate the quick-connect fitting, facilitating insertion. After docking of the sprayhead, a spring bias moves the collet to its second position which restricts radial expansion of the collet, discouraging extraction of the quick-connect fitting and inhibit said removal. In effect, the pulldown sprayhead may be docked to the spout with considerably less insertion force than the opposite removal force needed to undock the pull-down sprayhead from the spout. This makes docking more convenient, increases security of the docked sprayhead, and prevents inadvertent undocking, which improves usability and helps to avoid inadvertent breakage.

In addition, the sprayhead according to the present invention allows for the retention geometry to flex which reduces wear allowing for prolonged use with no noticeable degradation in either insertion force or removal force.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Reference will now be made in detail to preferred embodiments of the present invention, examples of which are illustrated in the accompanying drawings. Wherever possible, the same reference numbers will be used throughout the drawings to refer to the same or like parts.

Figure 1:
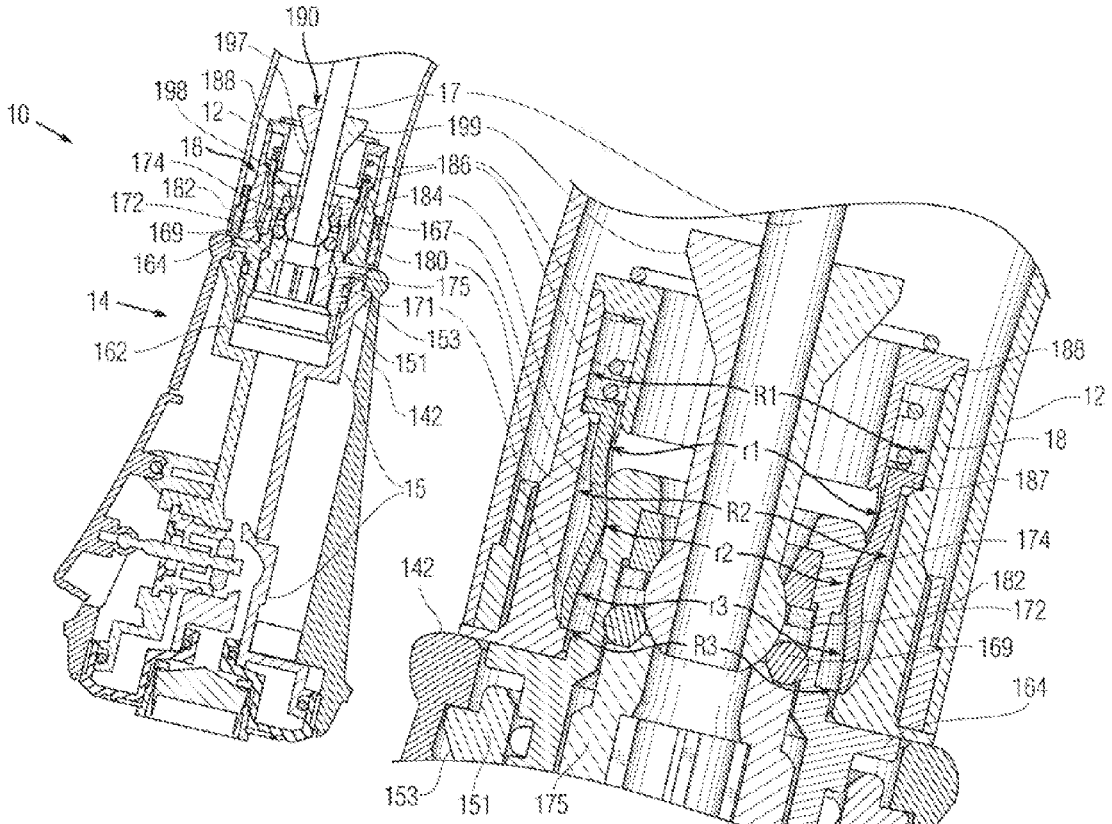
FIG. 1 is a composite cross-section of a faucet with pull-down sprayhead and docking system in accordance with the present invention, including an enlarged inset (right) of the sprayhead dock.

Referring now to FIG. 1 there is shown a cross-section of a faucet 10 configured with pull-down sprayhead 14 with docking system in accordance with the present invention. Faucet 10 includes a spout 12 having an internal conduit opening to an aperture, and sprayhead 14 here shown inserted in the spout 12. The sprayhead 14 is enclosed in a housing 142 having opposing (inlet and outlet) apertures. An internal waterway 15 is mounted in the housing 142 of sprayhead 14 in a known manner to support the internal valves and other components of the sprayhead 14, and the internal waterway 15 here extends to an annular basket 151 that is fixedly secured to the inlet aperture of the spray head 14.

Figure 2:
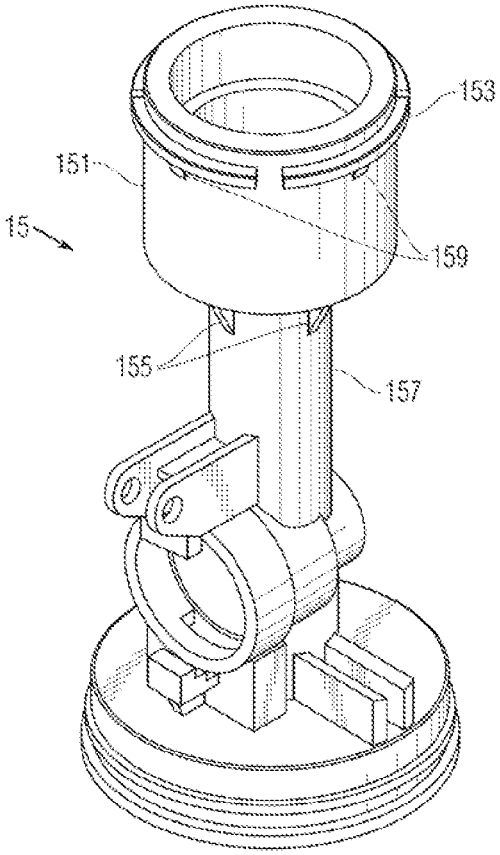
FIG. 2 is a perspective view of the internal waterway of the pull-down sprayhead of FIG. 1.
Figure 3:
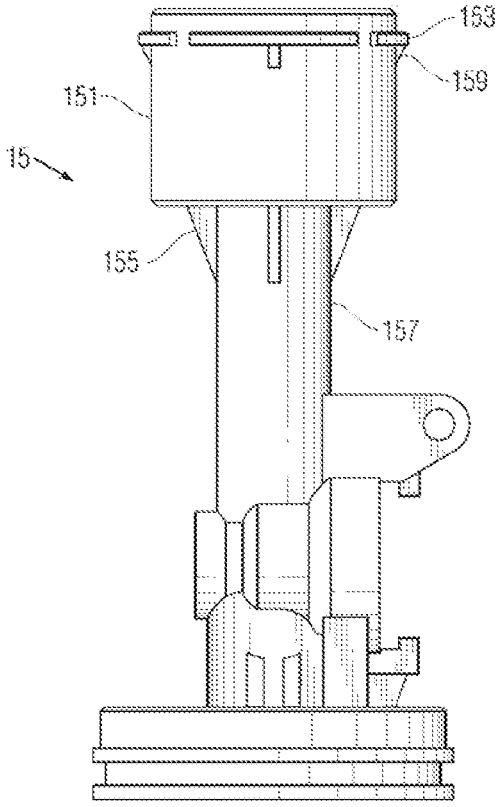
FIG. 3 is a side view of the internal waterway of FIG. 2.

FIG. 2 is a perspective view of the internal waterway 15, and FIG. 3 is a side view. The internal waterway 15 may be a molded plastic component, and communicates water from the spout 12 through the sprayhead 14 to a spray face which, in the illustrated embodiment, holds both aerate and spray holes. Though incidental to the present invention, a horizontally mounted poppet valve mounted on the waterway 15 is actuated by an external pivoting lever (see FIG. 1) to divert water between aerate and spray modes. Water is conducted along the central axis of the waterway 15 toward the spray face, and is selectively diverted by the valve to one of two exits. A first exit allows water to escape a ring shaped chamber at the base of the sprayhead 14 through multiple pinhole outlets forming a spray jet. A second exit allows water to escape a lower central chamber at the base having a single aerating exit discharging a single water stream. The lever diverts water between the first and second outlets and thus between aerate and spray modes. One skilled in the art will understand that the selective aerate and spray modes is an optional feature and incidental to docking the sprayhead 14 to the spout 12, and so the entire lower extent of the internal waterway 15 may take various forms as a matter of design choice.

With reference to FIG. 1, an annular basket 151 at the top end of the internal waterway 15 that is fixedly secured to the inlet aperture of the spray head 14. The basket 151 is an annular open ended form integrally molded and in fluid communication with the lumen 157 of the waterway 15 and includes a conventional hose coupling 162 within the interior of basket 151. The intersection of basket 151 and lumen 157 is preferably reinforced by flanges 155 or the like. The cylindrical outer wall of basket 151 is defined by a circular flange 153 which is notched for indexed seating in the housing 142 of sprayhead 14.

Figure 4:
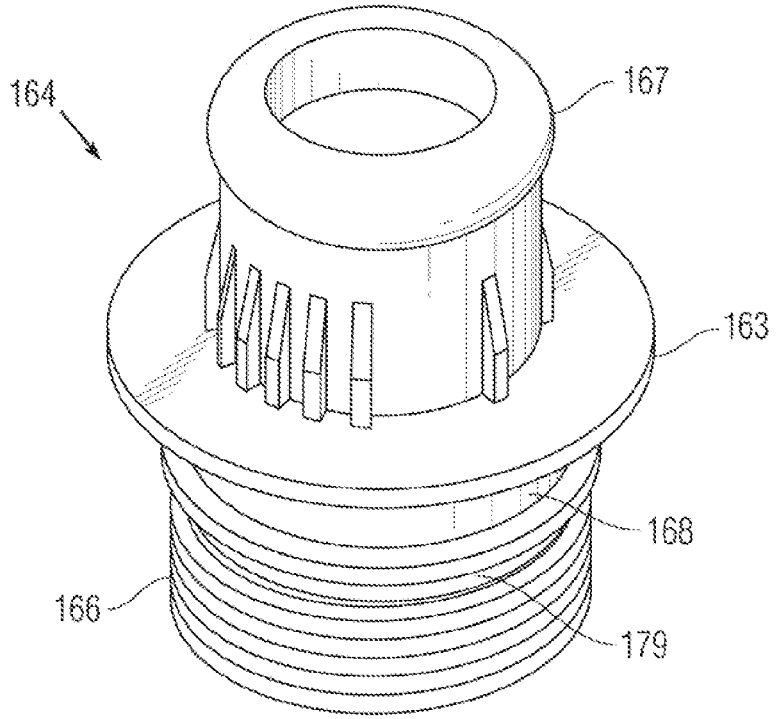
FIG. 4 is a perspective view of the cap of the pull-down sprayhead of FIG. 1.
Figure 5:
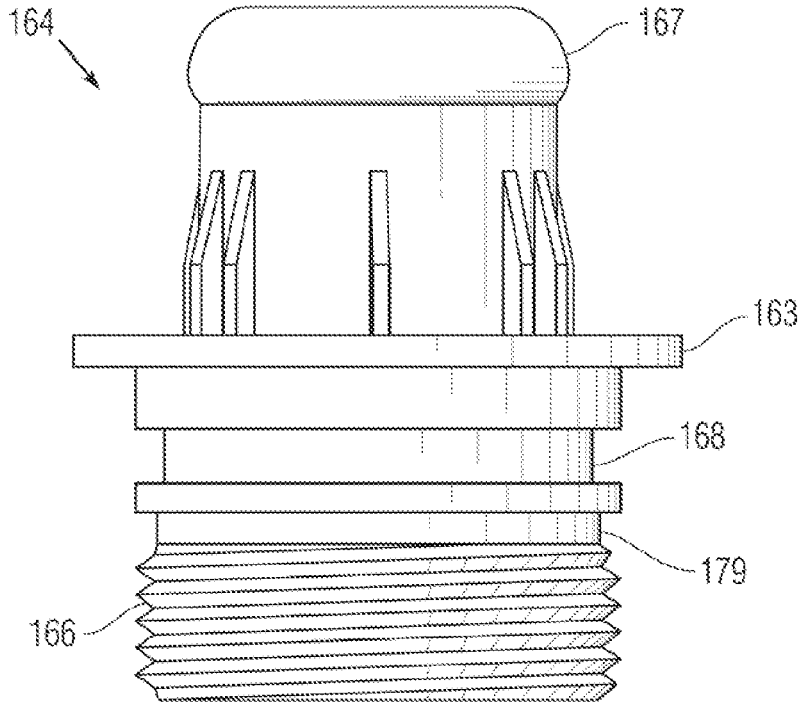
FIG. 5 is a side view of the cap of FIG. 4.

FIG. 4 is a perspective view of the cap 164, and FIG. 5 is a side view of the cap. The cap 164 may likewise be a molded plastic component and has a base section 166 that is received within the basket 151. The cap extends upward from the base section past a circular flange 163 at its midsection to a male quick-connect fitting 167 at a distal end that extends outward, from the sprayhead 14 (see. FIG. 1). The base section 166 is defined by two annular grooves 168, 179. An upper groove 168 seats an O-ring that seals the cap within the basket 151. The base section 166 is exteriorly threaded up to the lower groove 179 to facilitate screw-insertion into basket 151. The lower groove 179 serves as an index at the minor diameter of the threads to facilitate accurate positioning of the base section 166 and easier manufacturing. Quick-connect fitting 167 has a preferably rounded annular protrusion at it distal end that is received into or docks within a receptacle 18 inserted into the spout 12 of the faucet.

Referring back to FIG. 1, the receptacle 18 is fixedly mounted in the aperture of the distal end of the spout 12. The quick-connect fitting 167 of internal cap 164 in the spray head 14 is removably received within the receptacle 18 in the spout 12 to facilitate manual extraction and/or docking of the spray head 14 in the spout 12.

The internal waterway 15 is mounted inside the housing 142 of sprayhead 14, trapped therein by the circular flange 153 of basket 151 bearing underneath a lip at the inlet end of the sprayhead housing 142, and trapped at the outlet end by the sprayface which is secured at the outlet aperture of the sprayhead housing 142.

Basket 151 seats the hose coupling 162 of waterway 15. If desired, hose coupling 162 and basket 151 may be formed as a unitary component. The annular cap 164 wields quick-connect fitting 167 for mating with the receptacle 18 in the spout 12 to facilitate manual extraction and/or docking of the spray head 14 in the spout 12. The annular cap 164 surrounds the hose 17 and caps the annular basket 151

The hose 17 travels down to the hose coupling 162 and is outwardly sealed to the annular basket 151 by a balljoint 190 which is crimped to the hose 17. The balljoint 190 gives the hose 17 a limited degree of translation at the junction with hose coupling 162. The balljoint 190 has an enlarged fluted upper end 199 tapering to an annular midsection 197 and continuing to a bulbous distal end 198. The bulbous lower distal end 198 of the balljoint 190 is pressed against an O-ring 169 which is in turn seated atop a threaded adapter 175. The threaded adapter 175 seats atop the hose coupling 162 inside the annular cap 164. The bulbous lower distal end 198 of the balljoint 190 is held captive within the cap 164, sandwiched against O-ring 169 by a collar 174 held captive inside an inward lip of quick-connect fitting 167. A spacer 172, preferably an acetal spacer such as formed by Delrin® acetal resin adds compression to increase the compression on the O-ring 169. The O-ring 169 seals the bulbous lower distal end of balljoint 190, and yet this configuration gives the balljoint 190 and hose 17 a limited degree of flex and translation at the junction with the hose coupling 162. The hose 17 continues upward through the spout 12 to the water supply, and channels the water downward through the stem of the hose coupling 162 to an output which may include a volume control valve and/or spray/aerate mode selector assembly as described above.

Figure 6:
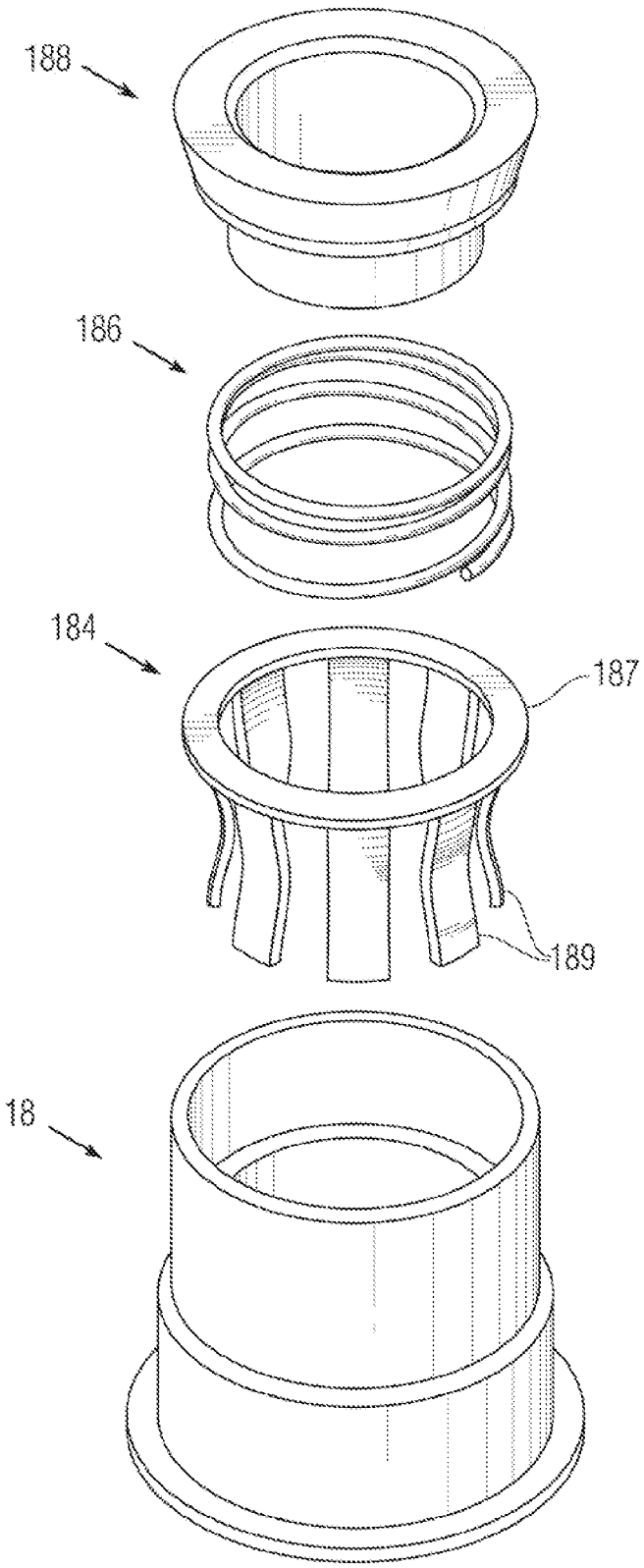
FIG. 6 is a perspective exploded view of the primary components of the docking system in accordance with the present invention.

In addition to the foregoing, several additional components are needed to implement the docking system in accordance with the present invention including receptacle 18, and a collet 184, coil spring 186 and sleeve 188. FIG. 6 is a perspective exploded view of these components (receptacle 18, and a collet 184, coil spring 186 and sleeve 188) as in FIG. 1.

The receptacle 18 inside the spout 12 aperture comprises an annular member with an outwardly extending bottom flange and sidewalls circumscribing an internal space within which a plastically deformable or resilient collet 184 is seated. It should be observed that the term "annular" as used herein is not limited to condition of a complete or 360 degree ring and the present invention can be satisfactorily practiced where the elements described herein trace only a portion of the annular form or other forms which are in included within the meaning of the term. The receptacle 18 completely covers the lower spout 12 aperture (and if necessary, may be surrounded by an optional shim 182 brazed into the lower spout 12 aperture). In the illustrated embodiment, receptacle 18 is threaded into adapter 182, and adapter 182 is brazed into the spout 12 aperture.

The collet 184 is itself a resilient, preferably annular member having a preferably contiguous circular upper member 187 with a plurality of curvilinear spring fingers 189 extending downwardly there from. The spring fingers 189 initially taper inward to a constricted midsection and then taper outward again toward their distal ends. The collet 184 is capable of a limited extent of up/down travel within the receptacle 18 with the downward travel limited by seating of its upper member 187 against an internal ridge inside receptacle 18. The collet 184 is biased into its downward position by a coil spring 186 which encircles a sleeve 188 surrounding the hose 17. One end of coil spring 186 abuts the upper lip of collet 184 while the other end of spring 186 abuts sleeve 188. The sleeve 188 has no direct interaction with the balljoint 190 but serves to keep the coil spring 186 captive in receptacle 18 and may be sonic-welded to the upper end of the receptacle 18 for this purpose. Upward travel of the collet 184 within the receptacle 18 is limited by the maximum compressive bias of the coil spring 186.

Importantly, the inner wall of receptacle 18 is sized in its midsection so that when the collet 184 is in its upward position, significant elastic deformation of the fingers 189 is permitted before the distal ends of the fingers engage the inner wall which serves to supplement the fingers own resilience such that further deformation is inhibited. However, the inner wall of the receptacle is chamfered inwardly toward a restricted lower end having a smaller size (e.g. diameter if a circular receptacle is assumed) such that little or no plastic deformation of the spring fingers 189 alone is permitted before the distal ends of the fingers engage the inner wall of the receptacle making further deformation considerable more difficult (i.e. requiring more force). When the quick connect fitting 167 is inserted inside the receptacle 18 it biases the collet 184 upward against coil spring 186 positioning the fingers 189 within the larger midsection of the receptacle which allows more room for expansion of the fingers 189 within the receptacle, thereby facilitating a looser fit of the quick connect fitting 167 inside the collet 184. Once the fitting 167 is inserted the spring bias returns the collet (with the fitting engaged) to the lower position such that deformation of the fingers is inhibited by engagement with the inner wall of the receptacle and the force needed to disengage the fitting 167 from the collet and remove the sprayhead is increased over the engagement/insertion force.

The present invention may be incorporated in a variety of sprayheads having different features, and the configuration of the internal waterway 15 may vary somewhat as a result.

As mentioned above, the receptacle 18 has tubular walls that circumscribe an internal space, and the inner walls of the receptacle 18 are stepped/chamfered from top to bottom to govern the motion of spring loaded collet 184. Specifically, the inner walls of the receptacle 18 are stepped/chamfered to define a cylindrical section with a first diameter R1 (see FIG. 1 inset), then stepped to a second smaller diameter R2, and then chamfered smoothly to a lip of smaller diameter R3 and aperture at the bottom.

Collet 184 may be molded of any resilient plastic capable of elastic deformation, defining the upper member 187 with plurality of curvilinear spring fingers 189 extending downwardly therefrom. The spring fingers 189 collectively follow a surface of revolution having a first diameter r1, then inwardly tapered to a second smaller diameter r2, and then outwardly tapered to a larger diameter r3 and opening at the bottom. The collet 184 is capable of a limited amount of up/down travel within receptacle 18; travel of the collet being upwardly limited by the maximum compression of spring 186 and downwardly limited by the upper member 187 of collet 184 engaging the step of receptacle 18. The spring 186 biases the collet in the downward or lower position.

The constricted midsection of the collet 184 engages or chokes on the quick-connect fitting 167 as the fitting passes into or out of the collet and thereby imparts both insertion force and retention force thereto. Given the travel of collet 184 within receptacle 18, the distal ends of the spring fingers 189 of collet 184 ride against the inner walls of receptacle 18. When the resilient collet 184 is biased into its lower position the chamfered inner wall of receptacle 18 at diameter R3 leaves less room for expansion, and yet when pushed into its upper position the chamfered inner wall of receptacle 18 at diameter R2 leaves more room for expansion of collet 184. Preferably, an air gap exists between R2 and the distal ends of the fingers r3 when the collet is in the upper position. When the quick-connect fitting passes through the constriction r2 of the collet the fingers deflect outward reducing the air gap potentially to the point that the distal ends engage the wall surface and inhibit further deflection. When the quick-connect fitting is past the constriction r2 of the collect, the fingers return to or toward their undeflected condition restoring, at least partially, the air gap. When the collet returns to the lower position under force of the biasing coil spring 186 the air gap is again diminished. This effectively accomplishes a differential insertion/extraction force, requiring less insertion force and more extraction force for ease of insertion and secure retention.

In operation, when the quick-connect fitting 167 nipple is inserted inside the receptacle 18 it biases the collet 184 upward against coil spring 186 which gives more room for expansion, thereby facilitating a looser fit of the quick connect 167 inside the receptacle 18. Conversely, when the quick-connect fitting 167 nipple is pulled outward from the receptacle 18 the collet 184 returns to the lower position which gives less room for expansion, thereby increasing the withdrawal force needed to remove the sprayhead 14. In the context of a pulldown sprayhead this requires significantly less force to dock than to undock, thereby easing use yet providing a secure dock, which combine to increase the operational lifetime. Those skilled in the art will understand that various modifications and variations can be made in the present invention without departing from the spirit or scope of the invention. It is to be understood, therefore, that the invention may be practiced otherwise than as specifically set forth in the appended claims.

What is claimed is:

1. A docking assembly for a pull-out sprayhead extendable from an aperture at a distal end of a faucet spout, comprising:

a receptacle fitted within said spout aperture, said receptacle defined as a generally annular member having a longitudinal axis, said receptacle having an interior surface chamfered down to a constricted opening at said spout aperture;

a resilient collet contained within said receptacle and adapted for travel along said longitudinal axis from a first position wherein said interior surface allows radial expansion of said collet to a second position wherein said constricted opening inhibits radial expansion of said collet;

a spring within said receptacle and engaged to said collet, said spring biasing said collet into said second position; and a fitting attached to said pull-out sprayhead, said fitting comprising an annular member for cooperative insertion into and removal from said receptacle and a distal end for engagement with said collet, whereby insertion of said distal end with sufficient force to overcome said spring-bias moves said collet to said first position allowing radial expansion of said collet to facilitate said engagement, after which said spring-bias returns said collet to said second position whereby the inhibited radial expansion of said collet requires a relatively greater force to disengage said distal end from said collet and remove said sprayhead from said spout.

2. The docking assembly according to claim 1, wherein said resilient collet comprises an annular member having a plurality of spring fingers protruding therefrom, said spring fingers engaging said interior surface of said receptacle at at least their distal ends.

3. The docking assembly according to claim 2, wherein said plurality of spring fingers follow a surface of revolution initially tapering inward to a smaller radius before tapering outward at their distal ends, said outwardly tapered distal ends engaging said interior surface of said receptacle.

4. The docking assembly according to claim 2, wherein said receptacle is cylindrical and further comprises a middle portion wherein said interior surface has a first diameter;

a distal portion defining said constricted opening wherein said interior surface has a second diameter less than said first diameter; and a chamfered portion wherein said interior surface transitions from said first diameter to said second diameter.

5. The docking assembly according to claim 4, wherein the minimum distance between said fingers defines a third diameter less than said second diameter and wherein said distal end of said fitting has a fourth diameter greater than said third diameter but less than said second diameter.

6. The docking assembly according to claim 4, wherein said collet defines a fifth diameter at said distal ends of said fingers, said fifth diameter sufficiently less than said first diameter so as to leave an air gap between said distal ends of said fingers and said inside surface of said middle portion of said receptacle when said collet is in said first position.

7. The docking assembly according to claim 1, wherein said spring is a coil spring.

8. The docking assembly according to claim 7, wherein upward travel of said collet within said receptacle is limited by the maximum compression of said spring.

9. A docking assembly for a faucet including a pull-down sprayhead extendable from a spout, comprising:

a receptacle fitted into a lower spout aperture of said faucet spout and having chamfered interior walls;

a flexible collet contained within said receptacle and adapted for travel along the chamfered interior walls thereof from a first position allowing radial expansion of said collet to a second position in which radial expansion of said collet is restricted; and a quick-connect fitting attached to said pull-down sprayhead for insertion and removal into/from said collet, whereby insertion of said quick-connect fitting moves said collet to said first position allowing radial expansion of said collet to facilitate said insertion, and removal of said quick-connect fitting moves said collet to said second position restricting radial expansion of said collet to inhibit said removal;

whereby said pulldown sprayhead may be docked to said spout with less insertion force than the removal, force needed to undock said pulldown sprayhead from said spout.

10. The docking assembly according to claim 9, wherein said flexible collet is spring-loaded for spring-biased travel along the chamfered interior walls of said receptacle.

11. The docking assembly according to claim 10, wherein said spring-loaded flexible collet comprises a continuous member with a plurality of spring fingers protruding therefrom.

12. The docking assembly according to claim 11, wherein said plurality of spring fingers follow a surface of revolution inwardly tapered to a smaller radius at its center.

13. The docking assembly according to claim 10, wherein said collet is capable of a limited extent of travel within said receptacle, upwardly limited by the maximum compression of said spring.

14. The docking assembly according to claim 9, wherein insertion of said quick-connect fitting pushes said collet to said first position allowing radial expansion of said collet to facilitate said insertion.

15. The docking assembly according to claim 14, wherein extraction of said quick-connect fitting pulls said collet to said second position causing radial contraction of said collet to hinder extraction.

* * * * *